US007034445B2

(12) United States Patent
Ha et al.

(10) Patent No.: US 7,034,445 B2
(45) Date of Patent: Apr. 25, 2006

(54) TENSION MASK FRAME ASSEMBLY AND COLOR CRT USING THE SAME

(75) Inventors: Kuen-Dong Ha, Seongnam (KR); Joon-Soo Bae, Seoul (KR); Gi-Young Song, Kangwon-do (KR)

(73) Assignee: Samsung SDI Co., Ltd., Suwon-si (KR)

( * ) Notice: Subject to any disclaimer, the term of this patent is extended or adjusted under 35 U.S.C. 154(b) by 181 days.

(21) Appl. No.: 10/459,541

(22) Filed: Jun. 12, 2003

(65) Prior Publication Data

US 2004/0012322 A1 Jan. 22, 2004

(30) Foreign Application Priority Data

Jul. 22, 2003 (KR) ..... 10-2002-0042917

(51) Int. Cl.
*H01J 29/80* (2006.01)

(52) U.S. Cl. ..... 313/407; 313/402

(58) Field of Classification Search ..... 313/402–407
See application file for complete search history.

(56) References Cited

U.S. PATENT DOCUMENTS 4,885,501 A * 12/1989 Tong ..... 313/402
5,672,935 A * 9/1997 Ito et al. ..... 313/406
6,069,437 A * 5/2000 Matsuki et al. ..... 313/407
6,111,347 A * 8/2000 Kwak ..... 313/402
6,144,149 A * 11/2000 Youn et al. ..... 313/407
2002/0036454 A1* 3/2002 Lee ..... 313/402
2002/0135286 A1 9/2002 Ha et al.
2003/0117057 A1* 6/2003 In et al. ..... 313/402

FOREIGN PATENT DOCUMENTS

JP 08-124489 5/1996

* cited by examiner

*Primary Examiner*—Ashok Patel
*Assistant Examiner*—Anthony Canning
(74) *Attorney, Agent, or Firm*—Robert E. Bushnell, Esq.

(57) ABSTRACT

A tension mask frame assembly of a color CRT includes a tension mask in which a plurality of electron beam passing holes are formed and a frame. The frame includes a pair of first and second support members separated a predetermined distance from each other and supporting the tension mask so that a tensile force is applied to the tension mask. First and second elastic members are installed between both end portions of each of the first and second support members, supporting the first and second support members to be separated a predetermined distance from each other to compensate for an amount of thermal expansion of the tension mask, and having inclined portions inclined at a predetermined angle. Bars connect the first and second support members and are made of a material having a thermal expansion coefficient smaller than that of the first and second elastic members.

20 Claims, 9 Drawing Sheets

TENSION MASK FRAME ASSEMBLY AND COLOR CRT USING THE SAME

CLAIM OF PRIORITY

This application claims priority to an application entitled "TENSION MASK FRAME ASSEMBLY AND COLOR CRT USING THE SAME" filed in the Korean Intellectual Property Office on Jul. 22, 2002 and assigned Ser. No. 2002-42917, the contents of which are incorporated herein in its entirety by reference.

BACKGROUND OF THE INVENTION

1. Field of the Invention

The present invention relates to a color cathode ray tube (CRT), and more particularly, to a tension mask frame assembly having an improved thermal compensation feature for compensating for "mislanding of an electron beam" (i.e., electrons that hit the mask and heat the mask as opposed to electrons that go through a slit in the mask to excite a flourescent film) due to thermal deformation of a mask receiving tension and a frame supporting the mask, and a color CRT using the same.

2. Description of the Related Art

In a typical color CRT, three electron beams are emitted from an electron gun, pass through electron beam passing holes of a mask having a color selection function, and then land on red, green, and blue fluorescent substances of a fluorescent film formed on a screen surface of a panel and excite the fluorescent substances, to form an image.

In the color CRT forming an image, the mask having a color selection function is divided into a dot mask adopted in a monitor of a computer and a slot (or a slit mask) mask used in a television. In a tension mask, one of the slot masks, considering a flat screen surface, tension is applied to the frame to compensate for distortion of an image and widen a view angle of a screen.

In such a scenario, not all of the electron beams go through the slots. Some of the electron beams impinge in the tension mask instead of going through to the flourescent film. These electron beams then heat the tension mask and the frame. If the design of the tension mask does not compensate for temperature changes, these electron beams that land on the tension mask will heat up the tension mask and the frame causing the mask and the frame to move. If these movements are not properly compensated for in the design of the frame, the slots will move thereby causing even a larger percentage of the electron beams to hit the mask instead of going through the slots resulting in a poorer image quality on the color CRT display.

What is needed is a design for a frame of a tension mask that properly compensates for all movements of the tension mask so that the quality of the image does not deteriorate with use.

SUMMARY OF THE INVENTION

It is therefore an object of the present invention to provide an improved design for a frame for a tension mask of a CRT display.

It is also an object of the present invention to provide a frame design for a tension mask that better compensates for thermal expansion thereby reducing the percentage of the electron beams that do not fall within a slit It is further an object of the present invention to provide a frame for a tension mask that has a simple structure and is thus inexpensive to produce.

It is also an object of the present invention to provide a novel frame for a tension mask that compensates for the rotational component of distortion of the mask caused by electron beams hitting the mask and not going through a slit in the mask.

These and other objects can be achieved by a tension mask frame assembly of a color CRT including a tension mask in which a plurality of electron beam passing holes are formed, and a frame including a pair of first and second support members separated a predetermined distance from each other and supporting the tension mask so that a tensile force is applied to the tension mask. First and second elastic members are installed between both end portions of each of the first and second support members, supporting the first and second support members and separating the first and second support members by the predetermined distance from each other to compensate for an amount of thermal expansion of the tension mask. The first and second elastic members have inclined portions inclined at a predetermined angle. Bars connect the first and second support members. The bars are made of a material having a thermal expansion coefficient smaller than that of the first and second elastic members.

The first and second elastic members can further include connection portions connecting the inclined portions. When the length of each of the connection portions is $L_1$ and the length of each bar is $L_2$, the lengths $L_1$ and $L_2$, satisfy the inequality $0 \leqq L_1 < L_2$.

An angle between the connection portion and the inclined portion is an obtuse angle. The angle between the inclined portion and the corresponding bar is an acute angle. These two angles are supplementary.

The bars are preferably made of one of Invar, Kovar, or Invar including nickel 42%, and the first and second elastic members are preferably made of Cr—Mo steel or SCM415.

According to another aspect of the present invention, a color CRT including a panel having a screen, a funnel sealed to the panel and having a cone portion and a neck portion, a deflection yoke installed throughout the cone portion and the neck portion of the funnel, an electron gun sealed in the neck portion, and a tension mask frame assembly installed in the panel to be separated a predetermined distance from each other, wherein the tension mask frame assembly includes a tension mask in which a plurality of electron beam passing holes are formed, and a frame including a pair of first and second support members separated a predetermined distance from each other and supporting the tension mask so that a tensile force is applied to the tension mask, first and second elastic members installed between both end portions of each of the first and second support members, supporting the first and second support members to be separated a predetermined distance from each other to compensate for an amount of thermal expansion of the tension mask, and having inclined portions inclined at a predetermined angle, and bars connecting the first and second support members and made of a material having a thermal expansion coefficient smaller than that of the first and second elastic members.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
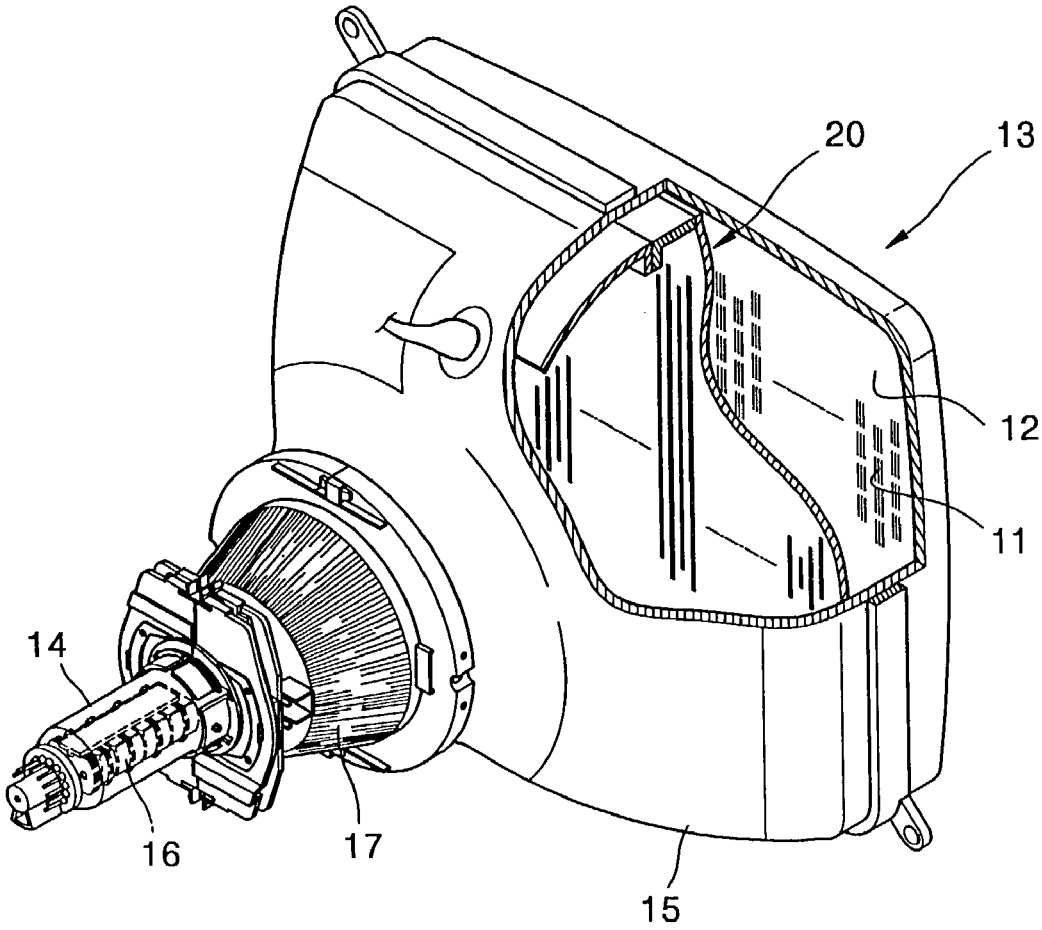
FIG. 1 is a partially cut-away perspective view illustrating a color CRT.

A mask frame assembly formed of a tension mask and a frame supporting the tension mask is installed in the panel of a color CRT. Turning to FIG. 1, FIG. 1 illustrates an example of a color CRT in which a mask frame assembly is installed.

Referring to the drawing, a color CRT includes a panel 12 having a flat screen surface 13 where a fluorescent film 11 is formed, a tension mask frame assembly 20 suspended on the inner surface of the panel 12, a funnel 15 sealed to the panel 12 in which an electron gun 16 is installed at a neck portion 14 of the funnel 15, and a deflection yoke 17 installed at a cone portion of the funnel 15.

Figure 2:
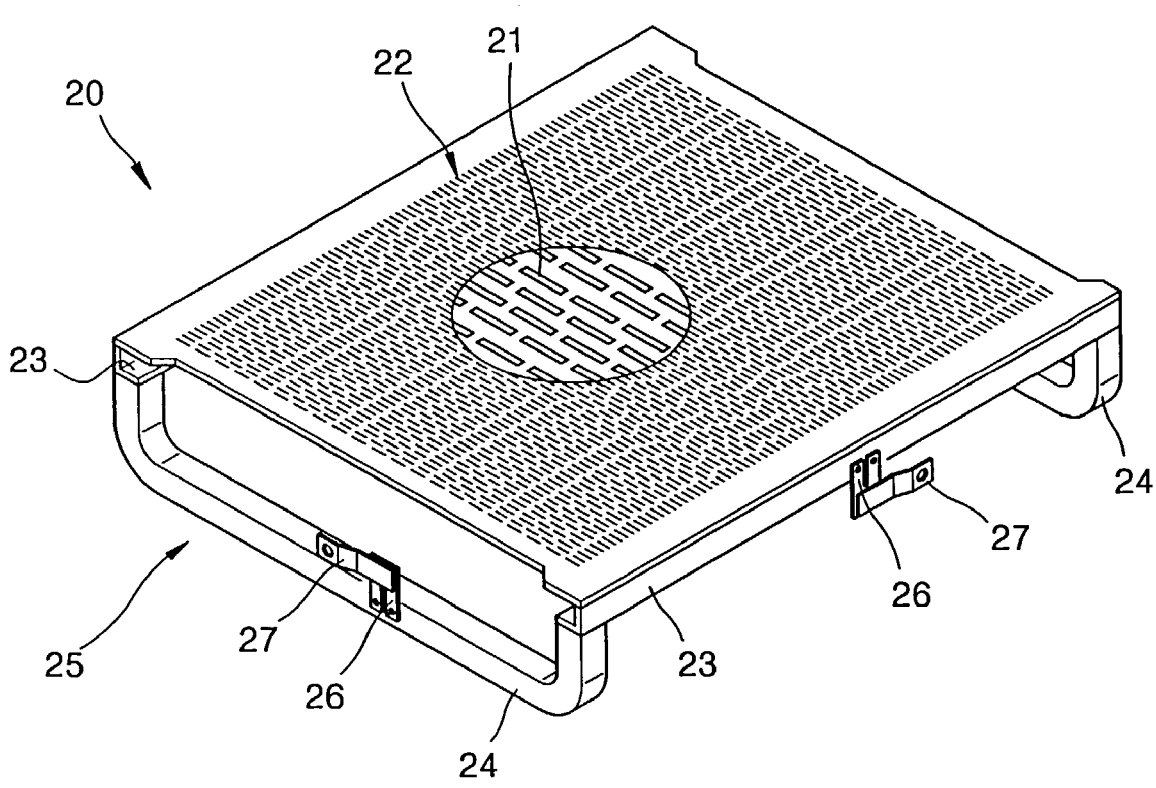
FIG. 2 is a perspective view illustrating a tension mask frame assembly.

The tension mask frame assembly 20, as illustrated in FIG. 2, includes a tension mask 22 where a plurality of slots 21 are formed and a frame 25 for supporting the tension mask 22. The frame 25 includes support members 23 supporting opposite edges of the tension mask 22 and elastic members 24 supporting end portions of the respective support members 23.

The mask frame assembly 20 is supported by a spring 28 and a spring supporter 26 at the support members 23 and the elastic members 24 and suspended in the inside of the panel 12 by a hook 27 coupled to a stub pin installed on an inner side surface of the panel 12.

In the tension mask frame assembly 20 having the above structure, as the spring supporter 26 made of bimetal is deformed by being heated by electron beams which do not pass through the slots 21 which are the electron beam passing holes, the tension mask frame assembly 20 is moved toward the panel 12 so that mislanding of the electron beams due to the thermal expansion can be compensated for.

The structure for supporting the panel of the tension mask frame assembly is disclosed in Japanese Patent Publication No. hei 8-124489.

Figure 3:
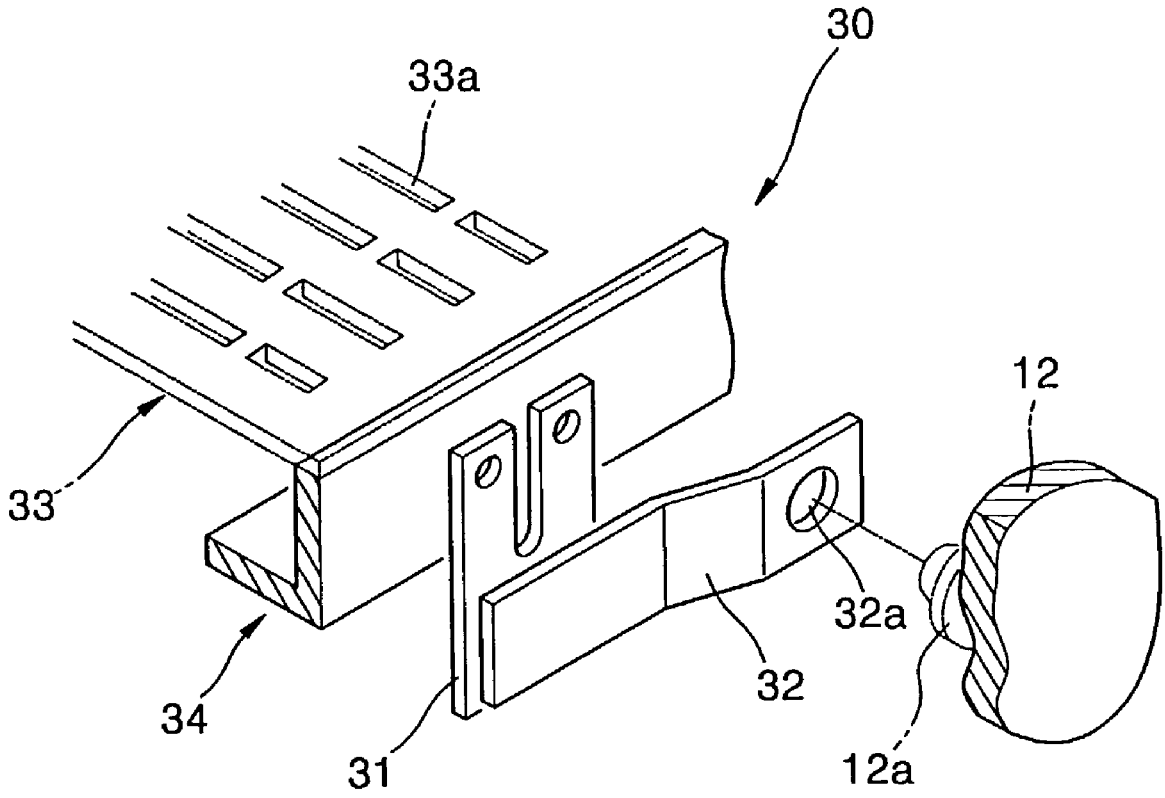
FIG. 3 is a perspective view illustrating a state of the tension mask frame assembly being installed at a panel.

As illustrated in FIG. 3, a spring supporter 31 made of a bimetal is fixed to the outer circumferential surface of the frame. A spring 32 where a coupling hole 32*a* is formed is fixed to one end of the spring supporter 31. The coupling hole 32*a* is coupled to a stud pin 12*a* installed on the inner surface of the panel 12. The spring 32 is made of the same material.

In a color CRT having the above structure to fix the tension mask frame assembly 30, an electron beam emitted from the electron gun 16 is deflected by the deflection yoke 17 and passes through a electron beam passing hole 33*a* of the tension mask 33 so that it lands on a fluorescent film to excite fluorescent substance.

In this process, all of the electron beams emitted from the electron gun do not pass through a slot which is the electron beam passing hole 33*a* of the tension mask, that is, part (15–25%) of the electron beam passes through it. The portion of the electron beam that does not pass through the electron beam passing hole 33*a* collides with the tension mask 33 to heat the tension mask 33. Thus, the tension mask 33 and the frame 34 support the tension mask 33 are heated by the electron beam, that is, thermions, and expand.

The thermal expansion of the tension mask 33 and the frame 34 makes the electron beam passing hole 33*a* of the tension mask 33 move so that much of the electron beam does not land (mislands) on the fluorescent film. The problem of mislanding of the electron beam can be solved as follows. As the spring supporter 31 made of the bimetal is thermally deformed, the tension mask frame assembly 30 is moved toward the panel 12. Thus, the electron beam passing hole 33*a* moved by the thermal deformation of the tension mask 33 is disposed on the original track of the electron beam so that the thermal expansion of the tension mask frame assembly 30 can be corrected.

However, as the spring supporter 31 thermally expands, the tension mask frame assembly 30 has a rotational component. The rotational component of the tension mask frame assembly 30 generates mislanding of the electron beam which deteriorates the quality of an image.

To solve the above problem, the present applicant filed U.S. patent application Ser. No. 09/938,838 and U.S. patent application Ser. No. 10/269,075 for a tension mask frame assembly.

Figure 4:
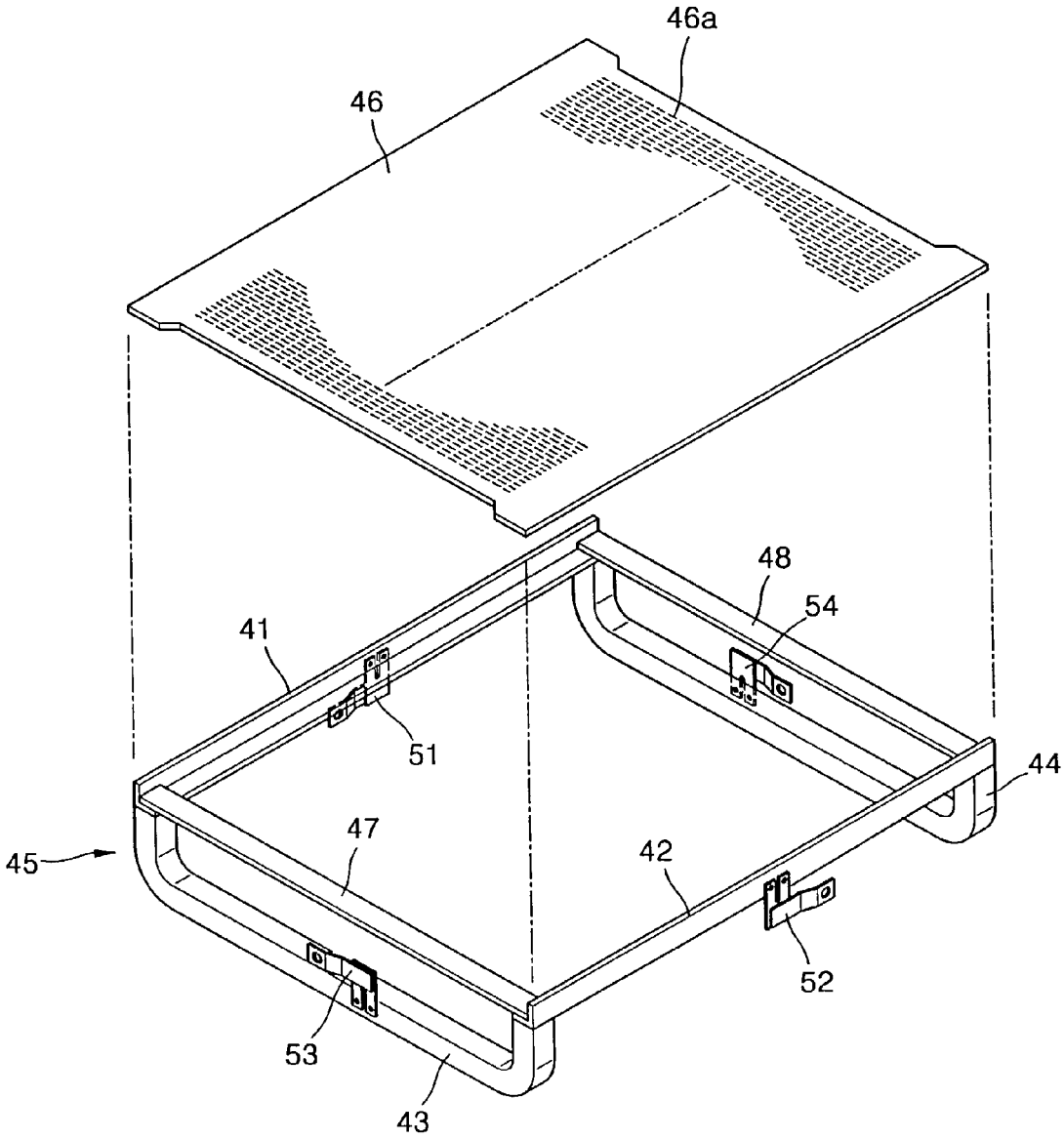
FIG. 4 is an exploded perspective view illustrating the tension mask frame assembly.

A tension mask frame assembly disclosed in U.S. patent application Ser. No. 10/269,075 is illustrated in FIG. 4. Referring to the drawing, a tension mask frame assembly includes a pair of first and second support members 41 and 42, a frame 45 including first and second elastic members 43 and 44 installed between the first and second support members 41 and 42 to support them to be separated at a predetermined distance, and a tension mask 46 installed to apply tension to the first and second support members and having a plurality of electron beam passing holes 46*a* formed therein. A pair of bars 47 and 48 are installed at the first and second support members 41 and 42 to compensate for mislanding of an electron beam due to thermal deformation of the mask and the frame by changing curvature of the first and second support members and the tension mask in a direction along the axis of a tube utilizing a difference in the amount of thermal expansion between the first and second elastic members 43 and 44 and the first and second support members 41 and 42. First and second hook members 51 and 52 are installed to extend upward at the first and second support members 41 and 42, respectively. Third and fourth hook members 53 and 54 are installed to extend upward at the first and second elastic members 43 and 44, respectively. The first through fourth hook members 51–54 are coupled to stud pins (not illustrated) installed on the inner surface of a panel (not illustrated) so that the tension mask frame assembly is suspended on the inner surface of the panel.

In the tension mask frame assembly having the above structure, during operation, as the tension mask 46 and the frame 45 thermally expand in order by the electron beam, a difference occurs in the amount of thermal expansion between the bars 47 and 48 and the first and second support members 41 and 42. Accordingly, the curvatures of the tension mask 46 and the first and second support members 41 and 42 change so that the mislanding of the electron beam is compensated for.

However, in the above tension mask frame assembly, the first and second hook members 51 and 52 extend downward so that free ends of the first and second hook members 51 and 52 are disposed under the first and second support members 41 and 42, respectively. The third and fourth hook members 53 and 54 extend above the first and second elastic members 43 and 44, respectively, so that free ends of the third and fourth hook members 53 and 54 are disposed above the first and second elastic members 43 and 44, respectively. During the thermal expansion, a direction in which the first and second hook members 51 and 52 extend is opposite to a direction in which the third and fourth hook members 53 and 54 extend.

Figure 5:
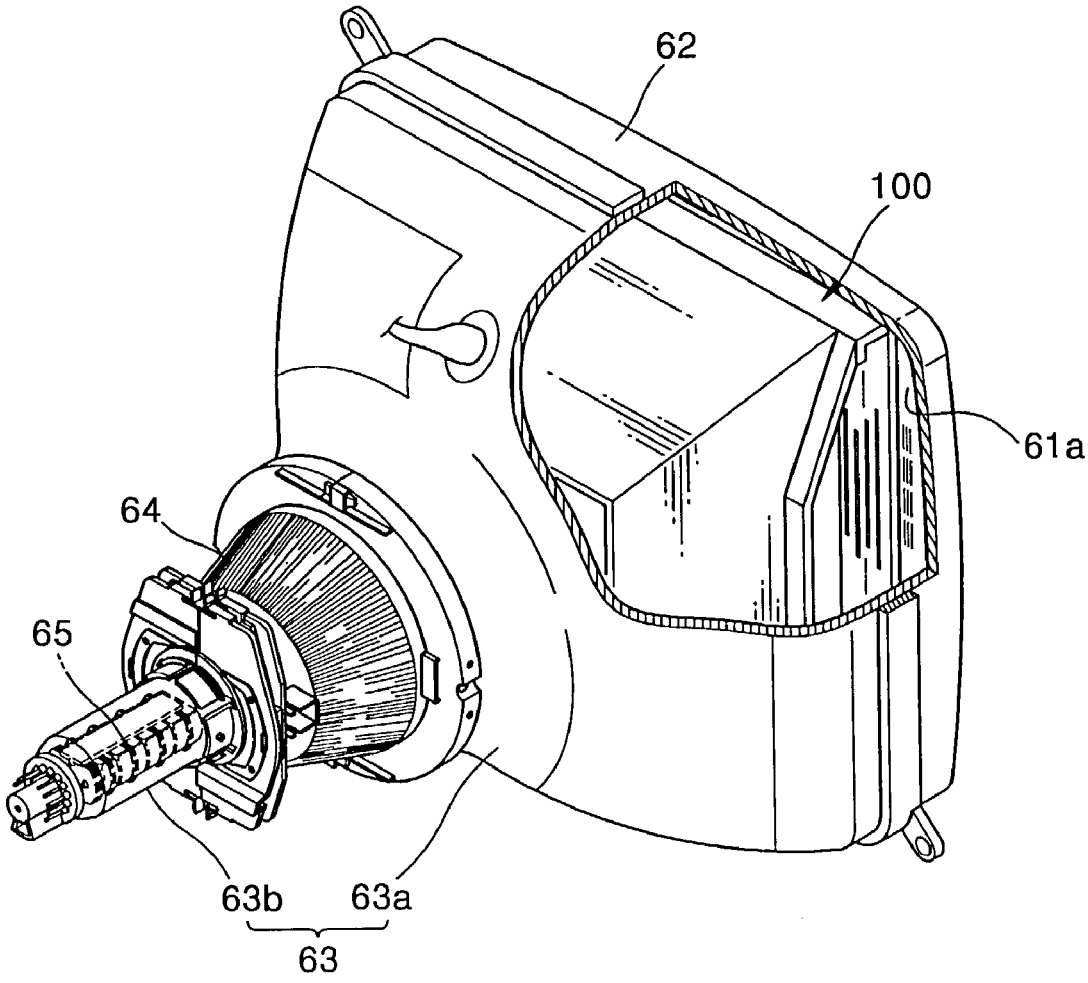
FIG. 5 is a partially cut-away perspective view illustrating a color CRT according to the present invention.

FIG. 5 illustrates an example of a color CRT according to the present invention. As illustrated in the drawing, a color CRT includes a panel 62 having a flat screen where a fluorescent film 61*a* is formed, a funnel 63 sealed to the panel 62 and having a cone portion 63*a* and a neck portion 63*b*, a deflection yoke 64 installed throughout the cone portion 63*a* and the neck portion 63*b* of the funnel 63, and an electron gun 65 sealed in the neck portion 63*b*. A tension mask frame assembly 100 having a color selection function of an electron beam emitted from the electron gun 65 is installed on the inner surface of the panel 62.

Figure 6:
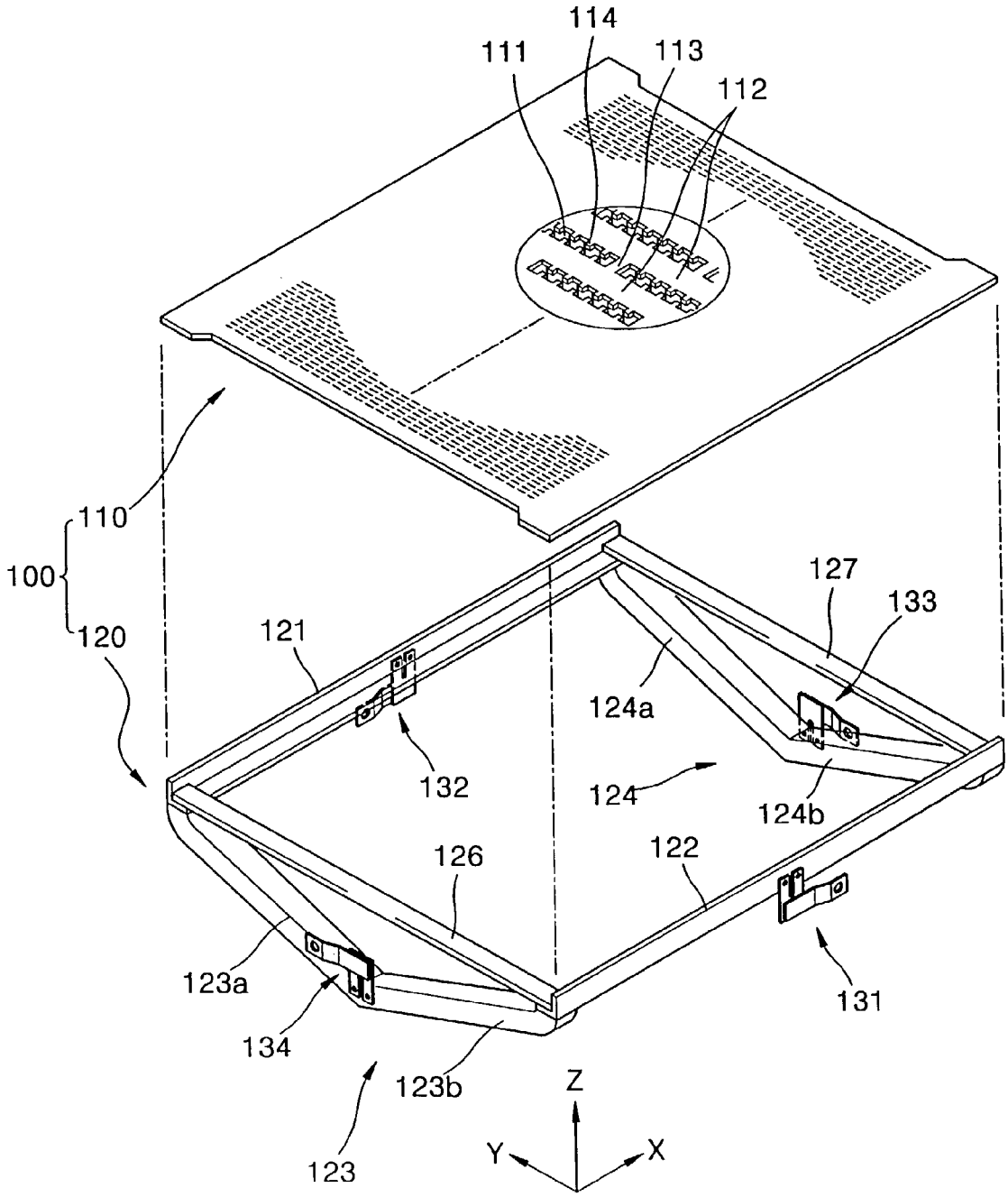
FIG. 6 is an exploded perspective view illustrating the tension mask frame assembly illustrated in FIG. 5.

The tension mask frame assembly 100, as illustrated in FIG. 6, includes a tension mask 110 having a plurality of slots lengthy in a Y direction (a direction in which a tensile force is applied) and a frame 120 supporting long side portions corresponding to an X direction which is the lengthwise direction of the tension mask 110 and applying a tensile force to the tension mask.

The tension mask 110 includes a plurality of strips 112 separated a predetermined distance from each other to form a slit 111, and a real bridge 113 connecting the neighboring strips 112 to section the slit 111. A dummy bridge 114 extending to each other to section the slit 111 may be formed at the strips 112. The tension mask is not limited to the above preferred embodiment and any structure of the tension mask to which a tensile force is applied can be adopted.

The frame 120 supporting both of the opposite edges of the tension mask includes a pair of first and second support members 121 and 122 separated a predetermined distance from each other, first and second elastic members 123 and 124 respectively having means for compensating for the amount of movement of an electron beam passing hole, that is, the slit 111, due to thermal expansion of the tension mask 110 supported by the first and second support members 121 and 122, and bars 126 and 127 connecting the first and second support members 121 and 122 and made of a material having a thermal expansion coefficient less than that of the first and second elastic members 123 and 124.

Figure 7:
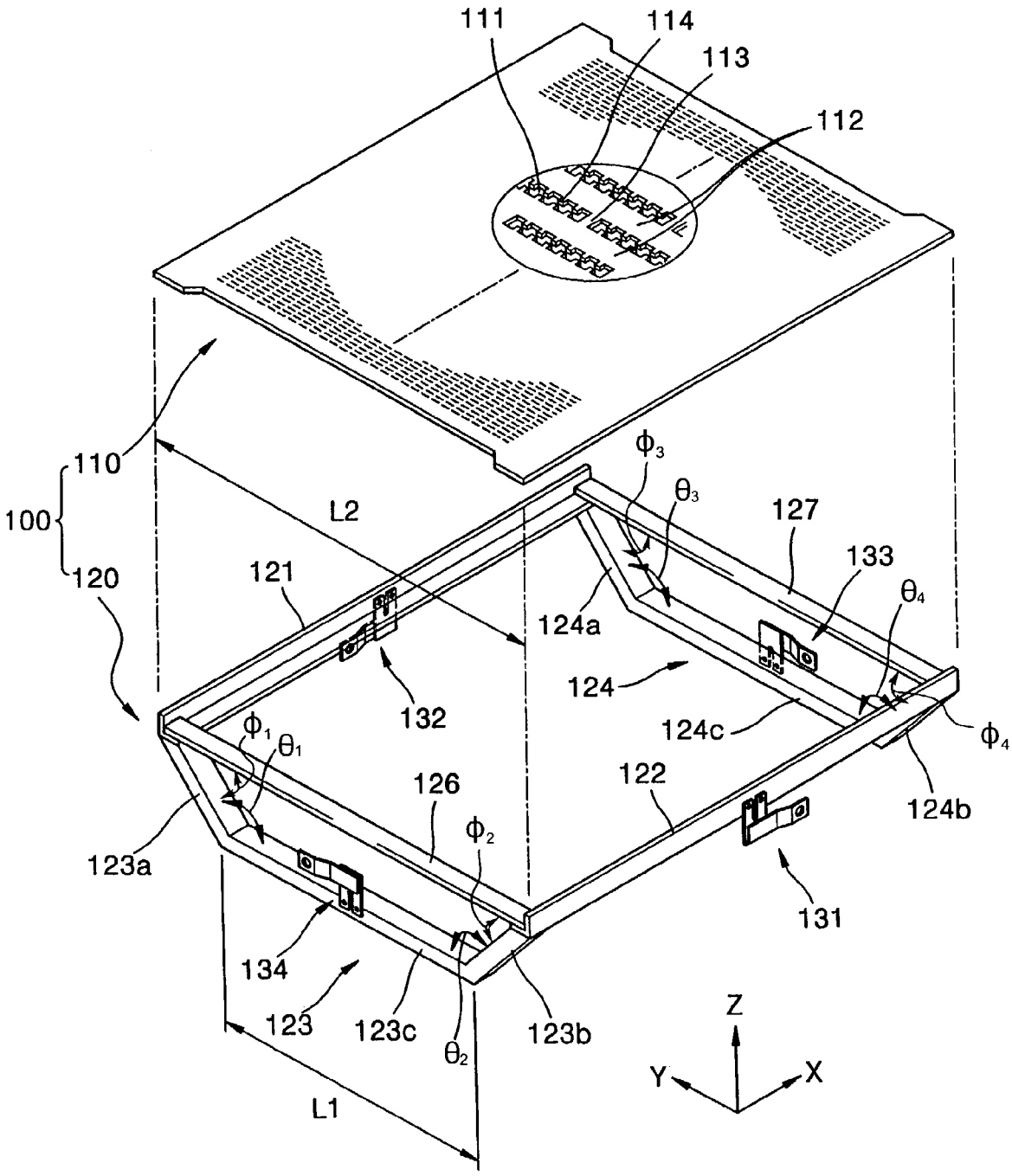
FIG. 7 is a perspective view illustrating a tension mask frame assembly according to another preferred embodiment of the present invention.

The compensation means formed at the first and second elastic members 123 and 124, as illustrated in FIG. 6, respectively includes inclined portions 123*a* and 123*b*, and 124*a* and 124*b* formed at both end portions of each of the first and second elastic members 123 and 124 connected to the first and second support members 121 and 122. The first and second elastic members 123 and 124 forms a V shape by the inclined portions 123*a*, 123*b*, 124*a*, and 124*b*, or may further provide connection portions 123*c* and 124*c* connecting the lower ends of the inclined portions 123*a*, 123*b*, 124*a*, and 124*b*, as illustrated in FIG. 7.

Assuming that the length of each of the connection portions 123*c* and 124*c* is $L_1$, and the length of bars 126 and 127 are $L_2$, the length $L_1$ of each of the connection portions 123*c* and 124*c* obeys the inequality $0 \leqq L_1 \leqq L_2$. L2 is also the length of the shorter sides of tension mask 110, in the same direction as slits 111. Also, the lengths of the inclined portions 123*a*, 123*b*, 124*a*, and 124*b* of the first and second elastic members 123 and 124 are preferably formed to be longer. In particular, it is preferable to adjust the lengths of the inclined portions 123*a*, 123*b*, 124*a*, and 124*b* by considering the installation of the third and fourth holder units 133 and 134 and the installation position of the mask frame assembly. The angles $\theta_1$, through $\theta_4$ between the connection portions 123*c* and 124*c* and the inclined portions 123*a*, 123*b*, 124*a*, and 124*b* extending from both end portions of the connection portions 123*c* and 124*c* form obtuse angles. Angles $\phi_1$, through $\phi_4$ are the angles between the inclined portions of the elastic members and the bars. Angles $\phi_1$, through $\phi_4$ are acute angles. Each pair of $\theta_i$ and $\phi_i$ are supplementary angles that total 180 degrees.

It is to be appreciated that the first and second support members 121 and 122 along with the bars 126 and 127 essentially form a perimeter around the tension mask 110 which is essentially rectangular in shape. Tension mask 110, bars 126 and 127 and the first and second support members 121 and 122 all are disposed in essentially the same plane. The term "essentially" is used here as the tension mask can distort a small amount. However, this distortion amount is small in comparison to the distance that the elastic members 123 and 124 deviate from the plane defined by the tension mask 110, bars 126 and 127 and the first and second support members 121 and 122.

The first and second elastic members 123 and 124 having the compensation means are not limited to the above preferred embodiment and any structure capable of moving the amount of movement of the first and second elastic members 123 and 124 due to the thermal expansion upward can be adopted.

First, second, third, and fourth holder units 131, 132, 133, and 134 coupled to stud pins (not illustrated) installed on the inner surface of the panel 62 to suspend the mask frame assembly 100 are installed at the first and second support members 121 and 122 and the first and second elastic members 123 and 124. At least one member forming the first, second, third, and fourth holder units 131, 132, 133, and 134 may be made of bimetal.

The bars 126 and 127 are made of Invar or Kovar and the first and second elastic members 123 and 124 are made of one of Cr—Mo steel, SCM415, and STS446. Here, Invar including nickel of 36% through 42% is preferably used. Invar and Kovar are metals that have very low and stable coefficients of thermal expansion. Invar is also known as Nilvar and is a controlled-expansion alloy. Invar alloy ordinarily contains 63.8% iron, 36% nickel and 0.2% carbon, but in this invention, a concentration of 36%–42% nickel is preferred. Kovar is an iron-nickel-cobalt alloy with a coefficient of thermal expansion similar to glass or silicon and thermal characteristics similar to alumina.

The operation of the color CRT adopting the tension mask frame assembly according to the present invention will now be described below.

In the tension mask frame assembly, the first, second, third, and fourth holder units 131, 132, 133, and 134 are coupled to the stud pins (not illustrated). When a color CRT suspended on the inner surface of the panel 62 is driven, part of the electron beam, that is, thermions, emitted from the electron gun 65 does not pass through a slit 111 which is the electron beam passing hole of the tension mask 110, but heats the tension mask 110, so that the tension mask 110 is heated and thermally expands. The amount of thermal expansion moves the slit 111 of the tension mask 110 so that mislanding of the electron beam is generated.

As the frame 120 is heated, the first through fourth holder units 131, 132, 133, and 134 are thermally expanded to move the frame 120 supporting the tension mask 110 toward the fluorescent film 61*a*.

In the step of compensating for the mislanding of the electronic beam according to thermal expansion, the first and second elastic members 123 and 124 supporting the first and second support members 121 and 122 of the frame 120 have the inclined portions 123*a*, 123*b*, 124*a*, and 124*b* which are the compensation means. Since the end portions of the first and second support members 121 and 122 are connected by the bars 126 and 127 having a relatively smaller thermal expansion amount, the thermal expansion amount of the first and second elastic members 123 and 124 causes the first and second support members 121 and 122 supporting the tension mask 110 to move to the front side. The inclined portions 123*a*, 123*b*, 124*a*, and 124*b* of the first and second elastic members 123 and 124 make the direction of the thermal expansion direct upward at its maximum so that the amount of movement of the first and second support members 121 and 122 can be maximized.

The above operation will be more clarified through the following experiments.

[Experiment 1]

In the present experiment, 32 inch color CRTs adopting the tension mask frame assembly according to the present invention are tested. Invar is used for the bars 126 and 127 installed at the end portions of the first and second support members 121 and 122 constituting the tension mask frame assembly and SCM415 is used for the first and second elastic members 123 and 124.

Figure 8:
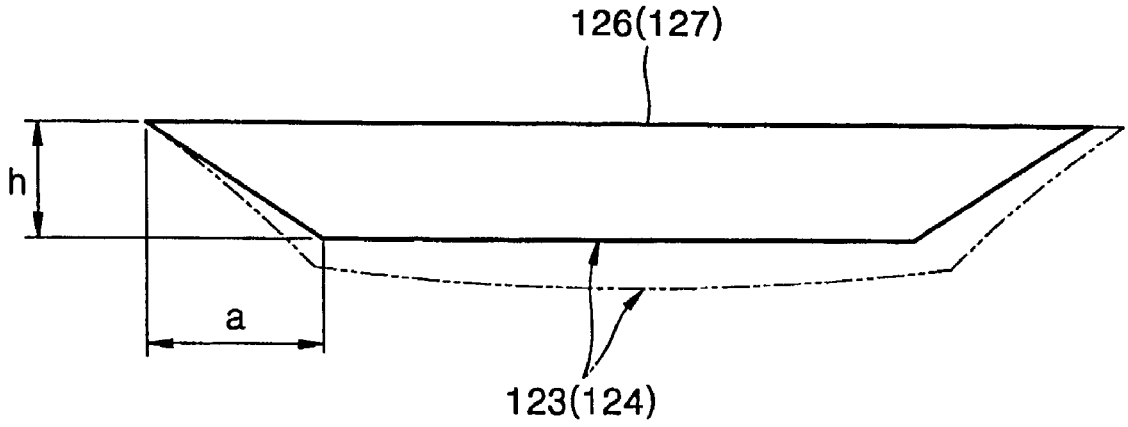
FIG. 8 is a view illustrating the compensation operation of the tension mask frame assembly according to the present invention.

In the above-described structure, as illustrated in FIG. 8, when a difference in temperature between the bars 126 and 127 and the first and second elastic members 123 and 124 occurs, the thermal expansion amount of the elastic members 123 and 124 act in the vertical direction so that the amount of movement of the first and second support members 121 and 122 increases.

[Experiment 2]

In the present experiment, 34 inch color CRTs adopting the tension mask frame assembly according to the present invention are tested. Invar is used for the bars 126 and 127 installed at the end portions of the first and second support members 121 and 122 constituting the tension mask frame assembly. Invar or chromium steel is used for the first and second elastic members 123 and 124 having the inclined portions 123*a*, 123*b*, 124*a*, and 124*b* which are the compensation means. In these cases, the amount of a vertical movement of the tension mask 110 supported by the first and second support members 121 and 122 according to the horizontal length of the inclined portion is measured and the result of the measurement is illustrated in Table 1.

TABLE 1

| | Horizontal Length of Inclined Portion (mm) ($L_2$–$L_1$) | | | | |
|---|---|---|---|---|---|
| | 0 | 30 | 59 | 88.5 | 118 |
| Material used in bars 126 and 127 | | | | | |
| Invar (experiment 1) | −84.6 | −96.5 | −110 | −122 | −131 |
| Chromium Steel (experiment2) | −37.3 | | −43.5 | | −48.9 |
| | Vertical Movement of Tension Mask in microns | | | | |

Figure 9:
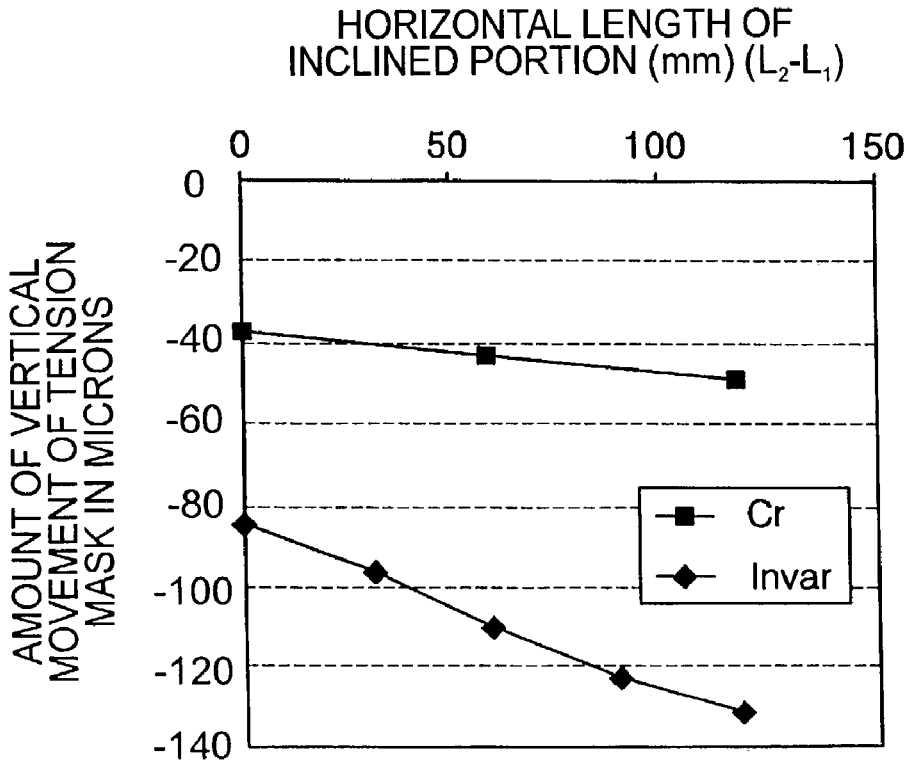
FIGS. 9 and 10 are graphs illustrating the amount of movement of the tension mask according to the materials of the first and second elastic members having the compensation means.
Figure 10:
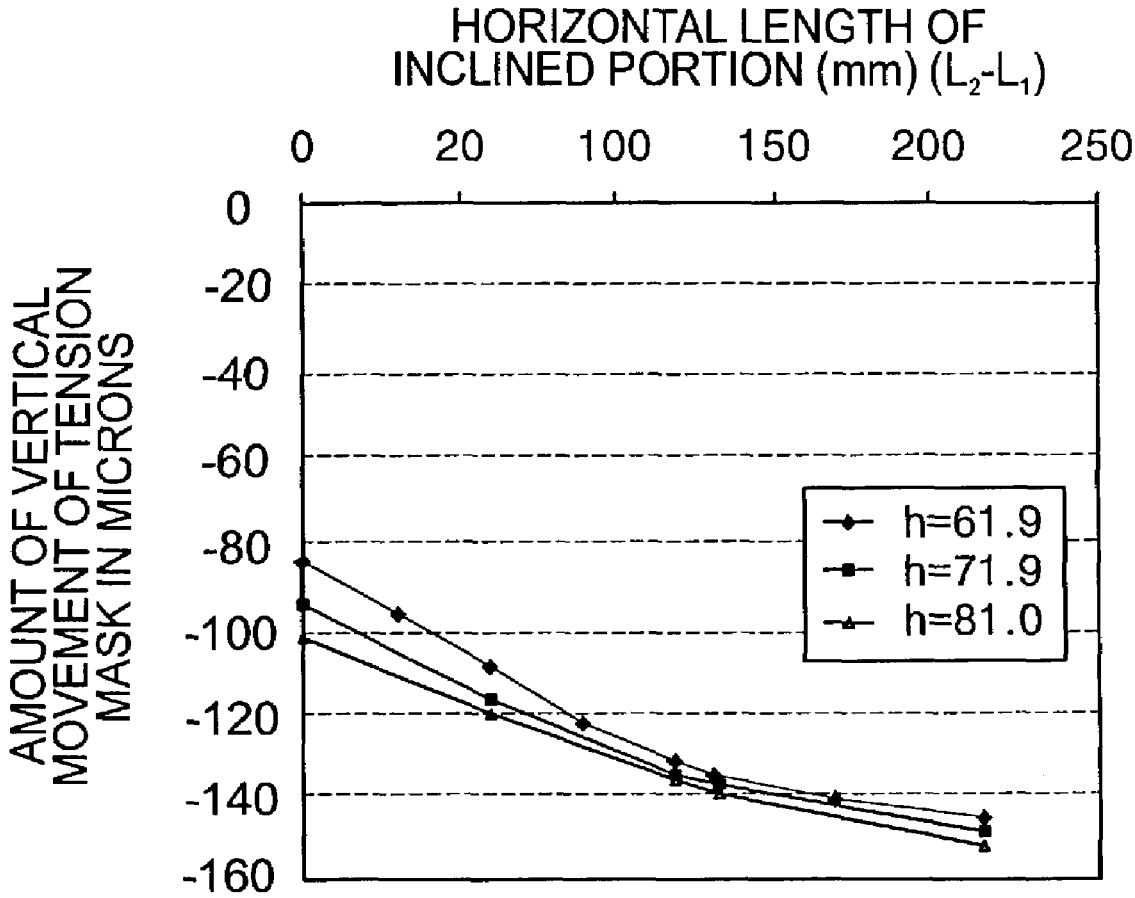

As illustrated in FIG. 8, while a vertical height h is changed with respect to horizontal distance a of the inclined portion, the amount of a vertical movement of the tension mask 110 supported by the first and second support members 121 and 122 is measured so that graphs of FIGS. 9 and 10 are obtained.

As can be seen from Table 1 and FIGS. 9 and 10, when a material having a relatively smaller thermal expansion coefficient is used for the first and second elastic members 123 and 124 and the length of the inclined portions 123*a*, 123*b*, 124*a*, and 124*b* which are the compensation means is formed at the elastic members to be longer, the amount of movement of the tension mask 110 in the vertical direction increases.

Also, it can be seen that the amount of the vertical movement of the tension mask 110 increases as the height of the inclined portions 123*a*, 123*b*, 124*a*, and 124*b* of the first and second elastic members 123 and 124 increases.

As described above, in the tension mask frame assembly of a color CRT according to the present invention, by changing the material of the first and second elastic members and forming the inclined portions which are the compensation means, the mislanding of the electron beam due to the thermal expansion of the tension mask can be compensated for. Furthermore, color purity of an image formed as the fluorescent film is exited by the electron beam can be improved.

While this invention has been particularly illustrated and described with reference to preferred embodiments thereof, it will be understood by those skilled in the art that various changes in form and details maybe made therein without departing from the spirit and scope of the invention as defined by the appended claims.

What is claimed is:

1. A tension mask frame assembly of a color CRT, comprising:

a tension mask perforated by a plurality of electron beam passing holes; and a frame, comprising:

first and second support members separated a first predetermined distance from each other and supporting the tension mask so that a tensile force is applied to the tension mask;

first and second elastic members installed between both end portions of each of the first and second support members and supporting the first and second support members to be separated said first predetermined distance from each other to compensate for an amount of thermal expansion of the tension mask; and a pair of bars connecting the first and second support members, said pair of bars and said first and said second support members forming essentially a closed rectangle that forms a periphery for said tension mask, said pair of bars, said tension mask and said first and second support members all being disposed in essentially a single plane, said first and said second elastic members having inclined portions that form acute angles with a corresponding support bar, said elastic members not being disposed in the same plane defined by the tension mask, the bars and the elastic support members.

2. The tension mask frame assembly of claim 1, wherein the first and second elastic members further comprise connection portions connecting the inclined portions, the connection portions being parallel to said bars, said connection portions not being in contact with said bars or said first and said second support members.

3. The tension mask frame assembly of claim 2, wherein, when the length of each of the connection portions is $L_1$ and said first predetermined distance is $L_2$, the lengths $L_1$ and $L_2$ satisfies the inequality $0 \leqq L_1 < L_2$.

4. The tension mask frame assembly of claim 2, wherein an angle between the connection portion and the inclined portion of each elastic member is an obtuse angle.

5. The tension mask frame assembly of claim 1, wherein a thermal expansion coefficient of the bars is smaller than that of the first and second elastic members.

6. The tension mask frame assembly of claim 1, wherein the bars are made of a material selected from the group consisting of a iron-nickel alloy containing 40–50% nickel and a nickel-cobalt ferrous alloy.

7. The tension mask frame assembly of claim 1, wherein the first and second elastic members are made of a material selected from the group consisting of Cr—Mo steel, SCM415 and STS446.

8. The assembly of claim 1, wherein holder units are disposed at middle portions of said first and said second elastic members and at middle portions of said first and said second support members, each holder unit having a free end disposed towards said panel, each holder unit comprising bimetal.

9. A color CRT, comprising:

a panel having a screen;

a funnel sealed to the panel and having a cone portion and a neck portion;

a deflection yoke installed throughout the cone portion and the neck portion of the funnel;

an electron gun sealed in the neck portion; and a tension mask frame assembly installed in the panel, the tension mask frame assembly being separated a first predetermined distance from the panel, wherein the tension mask frame assembly comprises:

a tension mask perforated by a plurality of electron beam passing holes, and a frame, comprising:

first and second support members separated by a second predetermined distance from each other, said first and said second support members supporting the tension mask so that a tensile force is applied to the tension mask;

first and second elastic members installed between both end portions of each of the first and second support members, supporting the first and second support members and separating said first and said second support members by said second predetermined distance to compensate for an amount of thermal expansion of the tension mask; and a pair of bars connecting the first and second support members and made of a material having a thermal expansion coefficient smaller than that of the first and second elastic members, said first and said second support members and said bars being disposed around a periphery of said tension mask, said first and said second elastic members having inclined portions that form acute angles with corresponding ones of said pair of bars.

10. The color CRT of claim 9, wherein the first and second elastic members further comprise connection portions that are parallel to the bars, said connection portions connecting the inclined portions.

11. The color CRT of claim 10, wherein, when the length of each of the connection portions is $L_1$ and the length of each bar is $L_2$, wherein $L_1$ and $L_2$ satisfy the inequality $0 \leqq L_1 < L_2$.

12. The CRT of claim 9, each end of each elastic member is attached to a part of a corresponding bar that is attached to a corresponding support member.

13. The assembly of claim 9, wherein holder units are disposed at middle portions of said first and said second elastic members and at middle portions of said first and said second support members, each holder unit having a free end disposed towards said panel and away from said electron gun.

14. A frame, comprising:

a first and a second bar, each bar disposed at an opposite end of a tension mask than the other bar;

a first and a second support member, each support member connecting end portions of separate bars, said pair of bars and said first and said second support member being disposed around a periphery of said tension mask, said pair of bars, said first and said second support member and said tension mask all being disposed in essentially a same plane;

a first elastic member connected to both ends of a first bar, said first elastic member having two inclined portions that form acute angles with corresponding ends of said first bar; and a second elastic member connected to both ends of a second bar, said second elastic member having two inclined portions that form acute angles with corresponding end portions of said second bar.

15. The frame of claim 14, said first and said second elastic members each having a connector portion disposed between said inclined portions, said connector portion being essentially parallel with each corresponding bar.

16. The frame of claim 14, said first and said second elastic members being made of a material having a higher coefficient of thermal expansion than material that makes up the bars.

17. The frame of claim 15, said first and said second elastic members being made of a material having a higher coefficient of thermal expansion than material that makes up the bars.

18. The frame of claim 15, each support member and each elastic member having holder units disposed at a middle thereof, each holder unit having a free end that points in a direction that is opposite to a direction of inclination of said first and said second elastic members.

19. The frame of claim 15, a length of each connection member being at least less than a length of each corresponding bar.

20. The frame of claim 18, each holder unit comprises bimetal.

* * * * *